US011427356B2

(12) United States Patent
Cere'

(10) Patent No.: US 11,427,356 B2
(45) Date of Patent: Aug. 30, 2022

(54) WRAPPING MACHINE

(71) Applicant: AETNA GROUP S.P.A., Verucchio (IT)

(72) Inventor: Mauro Cere', Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 152 days.

(21) Appl. No.: 16/632,070

(22) PCT Filed: Jul. 18, 2018

(86) PCT No.: PCT/IB2018/055339
§ 371 (c)(1),
(2) Date: Jan. 17, 2020

(87) PCT Pub. No.: WO2019/016727
PCT Pub. Date: Jan. 24, 2019

(65) Prior Publication Data

US 2020/0231313 A1 Jul. 23, 2020

(30) Foreign Application Priority Data

Jul. 20, 2017 (IT) ..... 102017000082697

(51) Int. Cl.
*B65B 11/02* (2006.01)
*B65B 11/58* (2006.01)
*B65B 11/00* (2006.01)

(52) U.S. Cl.
CPC ..... *B65B 11/025* (2013.01); *B65B 11/585* (2013.01); *B65B 2011/002* (2013.01); *B65B 2210/18* (2013.01)

(58) Field of Classification Search
CPC ..... B65B 2011/002; B65B 11/025; B65B 11/585; B65B 2210/18
(Continued)

(56) References Cited

U.S. PATENT DOCUMENTS 4,153,499 A * 5/1979 Annis ..... B65B 13/12 156/494
4,949,533 A 8/1990 Bate
(Continued)

FOREIGN PATENT DOCUMENTS

CN 201604820 10/2010
CN 104401522 3/2015
(Continued)

OTHER PUBLICATIONS

Office Action dated Mar. 29, 2021 in corresponding Chinese Patent Application No. 201880048058.X, with English-language translation.

(Continued)

*Primary Examiner* — Hemant Desai
*Assistant Examiner* — Mobeen Ahmed
(74) *Attorney, Agent, or Firm* — Wenderoth, Lind & Ponack, L.L.P.

(57) ABSTRACT

A wrapping machine for wrapping a product with a plastic film includes a frame, a supporting ring rotatably supported by the frame and rotated around a wrapping axis by a driving device, an unwinding unit fixed to the supporting ring and supporting a reel of film, pre-stretching rollers rotating about longitudinal axes and cooperating with each other to unwind and stretch the film, and a pre-stretching motor fixed to the frame and coupled to, and arranged to rotate, the pre-stretching rollers through a respective transmission assembly. The transmission assembly includes a driving ring rotatably supported by the frame and rotated about the wrapping axis by the pre-stretching motor through a friction roller, and a driving belt wound around, and rotated by, the driving ring and coupled to one pre-stretching roller to rotate the pre-stretching rollers when the driving ring is rotated by the pre-stretching motor.

11 Claims, 4 Drawing Sheets

(58) Field of Classification Search
USPC ..... 53/556, 588, 210
See application file for complete search history.

(56) References Cited

U.S. PATENT DOCUMENTS

| | | | | |
|---|---|---|---|---|
| 4,953,336 | A * | 9/1990 | Lancaster, III | B65B 11/008 53/176 |
| 5,787,691 | A * | 8/1998 | Turfan | B65B 11/025 53/588 |
| 5,829,234 | A * | 11/1998 | Suolahti | B65B 11/025 53/556 |
| 7,779,607 | B2 | 8/2010 | Lancaster, III et al. | |
| 7,854,105 | B2 * | 12/2010 | Zitella | B65B 57/04 53/441 |
| 8,037,660 | B2 | 10/2011 | Lancaster, III et al. | |
| 8,079,201 | B2 * | 12/2011 | Cere | B65B 11/585 53/399 |
| 8,276,346 | B2 | 10/2012 | Lancaster, III et al. | |
| 8,276,354 | B2 | 10/2012 | Lancaster, III et al. | |
| 8,365,508 | B2 * | 2/2013 | Kenney | B65B 13/04 53/589 |
| 8,448,412 | B2 * | 5/2013 | Cere | B65B 11/025 53/399 |
| 10,899,485 | B2 * | 1/2021 | Johnson | B65B 65/006 |
| 11,019,772 | B2 * | 6/2021 | Wildenberg | A01F 15/071 |
| 2003/0110737 | A1 * | 6/2003 | Lancaster, III | B65B 11/008 53/441 |
| 2006/0213155 | A1 * | 9/2006 | Forni | B65B 11/025 53/588 |
| 2006/0248858 | A1 * | 11/2006 | Lancaster, III | B65B 11/025 53/399 |
| 2007/0204564 | A1 * | 9/2007 | Lancaster, III | B65B 11/006 53/399 |
| 2007/0204565 | A1 | 9/2007 | Lancaster, III et al. | |
| 2007/0209324 | A1 | 9/2007 | Lancaster, III et al. | |
| 2009/0288372 | A1 * | 11/2009 | Cere | B65B 11/025 53/461 |
| 2011/0146203 | A1 * | 6/2011 | Lancaster, III | B65B 11/025 53/220 |
| 2012/0005985 | A1 | 1/2012 | Cere' | |
| 2012/0031053 | A1 | 2/2012 | Lancaster, III et al. | |
| 2012/0124944 | A1 | 5/2012 | Lancaster, III et al. | |
| 2012/0180433 | A1 | 7/2012 | Cere' | |
| 2015/0047301 | A1 * | 2/2015 | Messersi' | H02J 50/10 53/556 |

FOREIGN PATENT DOCUMENTS

| | | |
|---|---|---|
| EP | 0 289 784 | 11/1988 |
| EP | 1 705 119 | 9/2006 |
| WO | 2007/100597 | 9/2007 |
| WO | 2008/007189 | 1/2008 |
| WO | 2017/051343 | 3/2017 |

OTHER PUBLICATIONS

International Search Report dated Oct. 2, 2018 in International (PCT) Application No. PCT/IB2018/055339.

* cited by examiner

WRAPPING MACHINE

The invention concerns machines for wrapping a load with a cold-stretchable plastic film or wrap and, in particular, concerns a rotating-ring wrapping machine.

Known wrapping machines comprise an unwinding apparatus which supports a reel from which the plastic film is unwound in order to be wrapped around the load so as to form a series of strips or bands having a helical arrangement, thanks to the combination of relative linear and rotating movements between the wrapping apparatus and load, the latter being formed by one or more products, for example arranged on a pallet or palette.

In the horizontal rotating-ring wrapping machines, the load remains static during the wrapping, while the unwinding apparatus is moved with respect to the latter both by rotating about a vertical wrapping axis and by translating along the latter. For this purpose, the unwinding apparatus is fixed to a ring structure, the so-called rotating ring, which is rotatably supported by a supporting frame or carriage so as to rotate about a vertical wrapping axis. The supporting carriage is in turn slidably secured to a fixed main frame of the wrapping machine so as to translate parallel to the vertical wrapping axis. In doing so, the film unwinding apparatus is movable along, and about, the wrapping axis while the load to be wrapped remains fixed.

In vertical-ring wrapping machines, the load is instead moved horizontally through the rotating ring, while the unwinding apparatus rotates with the latter about a horizontal wrapping axis. The rotating ring is rotatably supported by the fixed main frame of the machine.

The unwinding apparatus is generally provided with a couple of pre-stretching rollers, formed by a slow roller and a fast roller, respectively placed upstream and downstream with respect to the unwinding direction of the film, to unwind and stretch or lengthen the film, and one or more return rollers to deflect the film towards the load during unwinding. By appropriately adjusting the difference between the rotational speeds of the pre-stretching rollers, it is possible to stretch or lengthen a defined amount of the film exiting the unwinding apparatus, according to a predetermined pre-stretching or elongation percentage, before it is wrapped around the load, to make the best use of the film available and/or to change the mechanical characteristics of the material of the film itself, depending on the product to be wrapped.

As is known, the pre-stretching force makes it possible to considerably reduce the thickness of the film (typically from about 23/25 μm approximately 6/7 μm) so as to proportionally increase its length to wrap a greater number of loads or products. Moreover, the material of the suitably stretched film can change from having an elastic-type behaviour, in which the film tends to recover its original size when the stretch is not applied, to a plastic-like behaviour, in which the film is permanently deformed and cannot recover its original size when the stretch is not applied. In the latter case, the film of plastic material behaves like a flexible and inextensible element, similar to a rope or a belt, and can be used, for example, to wrap groups of unstable products that must be kept firmly bound to each other.

By adjusting the rotation speed of the pre-stretching rollers, it is also possible to vary the unwinding speed of the film from the reel, i.e. the speed at which the film exits the unwinding apparatus.

Known wrapping machines are provided with an electric motor mounted on the unwinding apparatus and capable of rotating one of the two pre-stretching rollers acting as a driving roller (master), typically the fast roller, which uses a mechanical transmission assembly to operate the other pre-stretching roller acting as a driven roller (slave), typically the slow roller. In doing so, a predetermined drive ratio is imposed between the fast roller and the slow roller, as a function of the percentage of elongation to carry out on the film.

The electric motor which drives the pre-stretching roller can be powered by an alternator, positioned on the unwinding apparatus, provided with a pinion which engages with a rack positioned on a fixed coaxial ring and arranged externally with respect to the rotating ring. In doing so, when the rotating ring rotates, the pinion is driven in rotation by the fixed rack and the current which supplies the motor is generated.

In other machines, the alternator may be provided with a pulley driven in rotation by a fixed belt. The belt is arranged to rotate the pulley when the rotating ring is rotated, which supports the alternator, so as to generate the current that supplies the motor.

Alternatively, the electric motor can be powered by batteries positioned on the opposite side of the rotating ring with respect to the reel holder or by sliding contacts, positioned and operating at a fixed external ring mounted on the support carriage.

Other known wrapping machines have unwinding apparatuses provided with a couple of electric motors arranged to operate the two pre-stretching rollers separately and independently, so as to allow variation of the lengthening of the film, i.e. the percentage of pre-stretching or elongation even during operation or the wrapping of the load.

The two electric motors are powered using the same solutions described above for the single electric motor.

The known wrapping machines can comprise feedback control systems for maintaining the wrapping or strain of the film around an almost-constant load by suitably varying the film unwinding speed, that is, its speed of exit from the unwinding apparatus by means of the feedback adjustment of the rotation speed of the pre-stretching rollers.

Sensors are provided for this purpose (for example sensors or transducers in an angular position for a dancer roller, for a film return roller, torque sensors mounted on the motors) which are capable of directly or indirectly measuring the strain of the film and sending a relative signal to a control unit of the wrapping machine. The control unit is able to intervene on the motor or motors of the pre-stretching rollers to increase or decrease the rotation speed.

The variation of the wrapping force or strain, as it is known, is caused by the dimensions, the cross-sectional shape of the load to be wrapped, its position with respect to the wrapping axis, i.e. the relative angular position between the load and the unwinding apparatus during each wrapping rotation.

A defect of the aforementioned wrapping machines is the total mass of the rotating ring, which causes considerable inertial forces during operation, the total rotating mass comprising that of the electric motor or motors, the counterweights and, where present, the alternator or control device batteries with a dancer roller.

The mass of the rotating ring greatly reduces the maximum rotation speed and consequently limits the productivity of the wrapping machine.

Furthermore, to counteract the forces of inertia that are generated in the rotation of the rotating ring, it is necessary to considerably stiffen the main fixed frame and the supporting carriage, with a consequent further increase in weight and an increase in costs.

Other known wrapping machines have an electric motor which drives one of the pre-stretching rollers and is mounted on the fixed frame or on the supporting carriage, and not on the wrapping apparatus so as to not rotate with the rotating ring. In doing so, its power supply is simpler, but motion transmission means are necessary to connect the motor to the pre-stretching roller. Such motion transmission means comprise a plurality of belts which are wound on return pulleys fixed to the rotating ring or to the supporting carriage and which connect a driving pulley fixed to the electric motor to a driven pulley of the pre-stretching roller.

WO 2008007189 describes a wrapping machine for wrapping a product with a plastic film that comprises frame means rotatably supporting ring means that rotates about a wrapping axis and support carriage means arranged to support a reel of film, and a first roller and a second roller to unwind and pre-stretch the film. The wrapping machine includes first motor means and second motor means fixed to the supporting frame means and coupled to the first roller and second roller respectively.

A disadvantage of these wrapping machines is the complexity of the motion transmission means, which implies an increase in machine costs and mandatory periodic maintenance for adjustments and fine-tuning.

Another disadvantage is the delay in the control of the pre-stretching rollers due to the length and complexity of the motion transmission means.

If the feedback control devices comprise sensors or transducers in an angular position associated with the dancer roller or one of the return rollers of the unwinding apparatus, a relatively limited amount of time elapses from the moment in which the signals are sent by the sensors to that in which the electric motor of the pre-stretching rollers varies its rotation speed (the electric motor is controlled by the machine control unit on the basis of the signals received from the sensors). However, a considerably longer amount of time is necessary for the speed of the pre-stretching rollers to effectively change as a result of the variation in speed of the electric motor, due to the length and complexity of the motion drive means. The resulting delay in the feedback control of the pre-stretching rollers, especially when the wrapping machine is at high operating speeds, can cause excessive strain of the film on unwanted portions of the load, up to the breaking of the film or an insufficient wrapping tension in other portions of the load.

When the control devices comprise a sensor of the driving torque associated with the electric motor, the length and complexity of the driving means causes a delay in detecting the variation of the film wrapping strain (since this variation is detected by the sensor mounted on the motor) and a further delay in the subsequent adjustment of the speed of the pre-stretching rollers.

An object of the invention is to improve the known wrapping machines arranged to wrap a load with a cold-stretchable plastic film, in particular rotating-ring wrapping machines. Another object is to provide a wrapping machine able to operate at high rotating-ring rotation speeds so as to increase productivity with respect to known machines.

A further object is to provide a wrapping machine which makes it possible to effectively and precisely vary the drive ratio between the pre-stretching rollers and to control, and more specifically maintain almost constant, a force or strain on the film wrapped around the load, even at high rotating-ring rotation speed.

Another object is to provide a sturdy and reliable wrapping machine able to ensure optimum wrapping of loads with plastic film.

These and other objects are achieved by a wrapping machine according to one or more of the following claims.

The invention can be better understood and implemented with reference to the attached drawings, which illustrate an exemplifying and non-limiting embodiment thereof, wherein.

Figure 1:
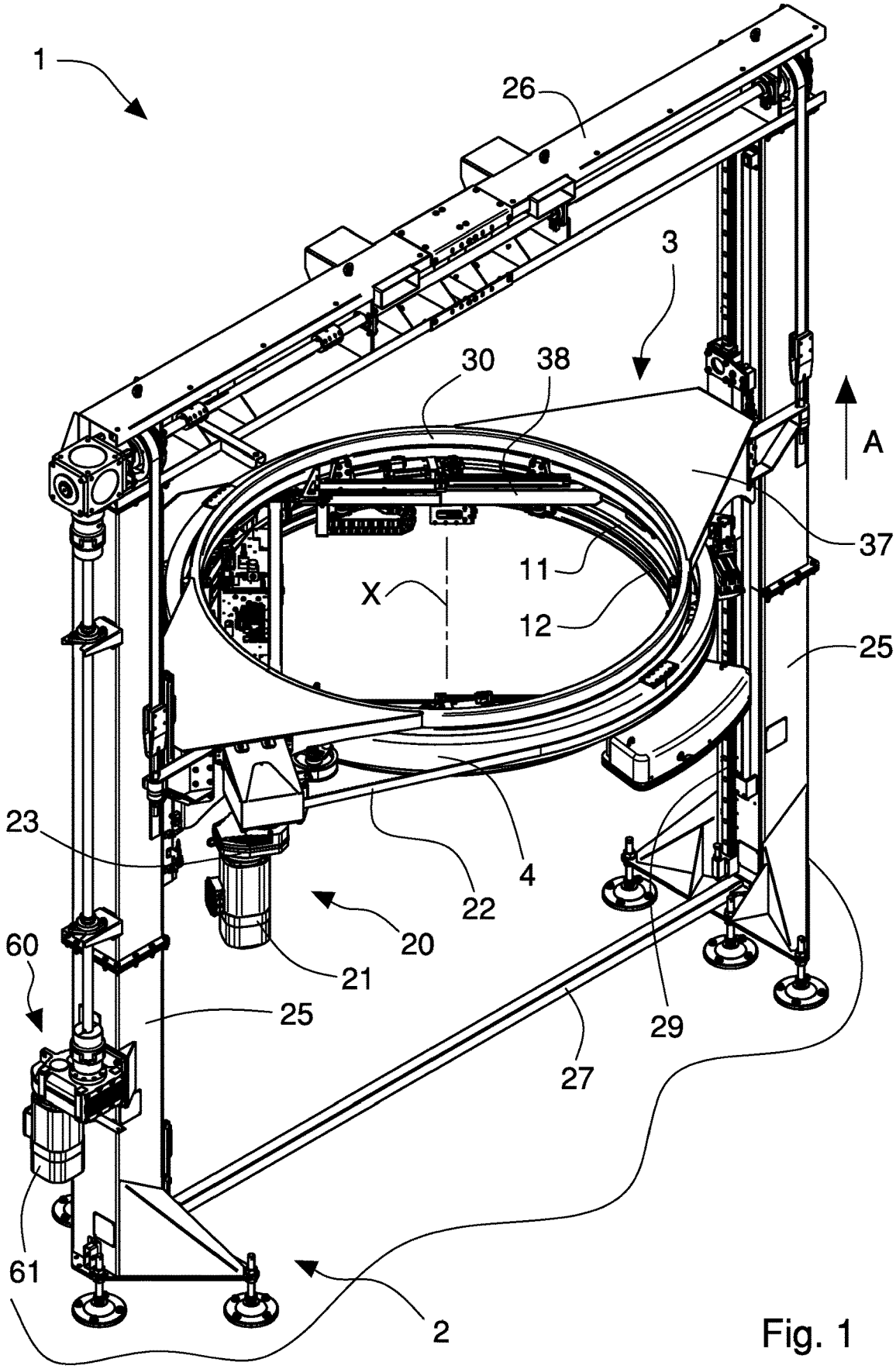
FIG. 1 is a perspective view of the wrapping machine according to the invention.
Figure 2:
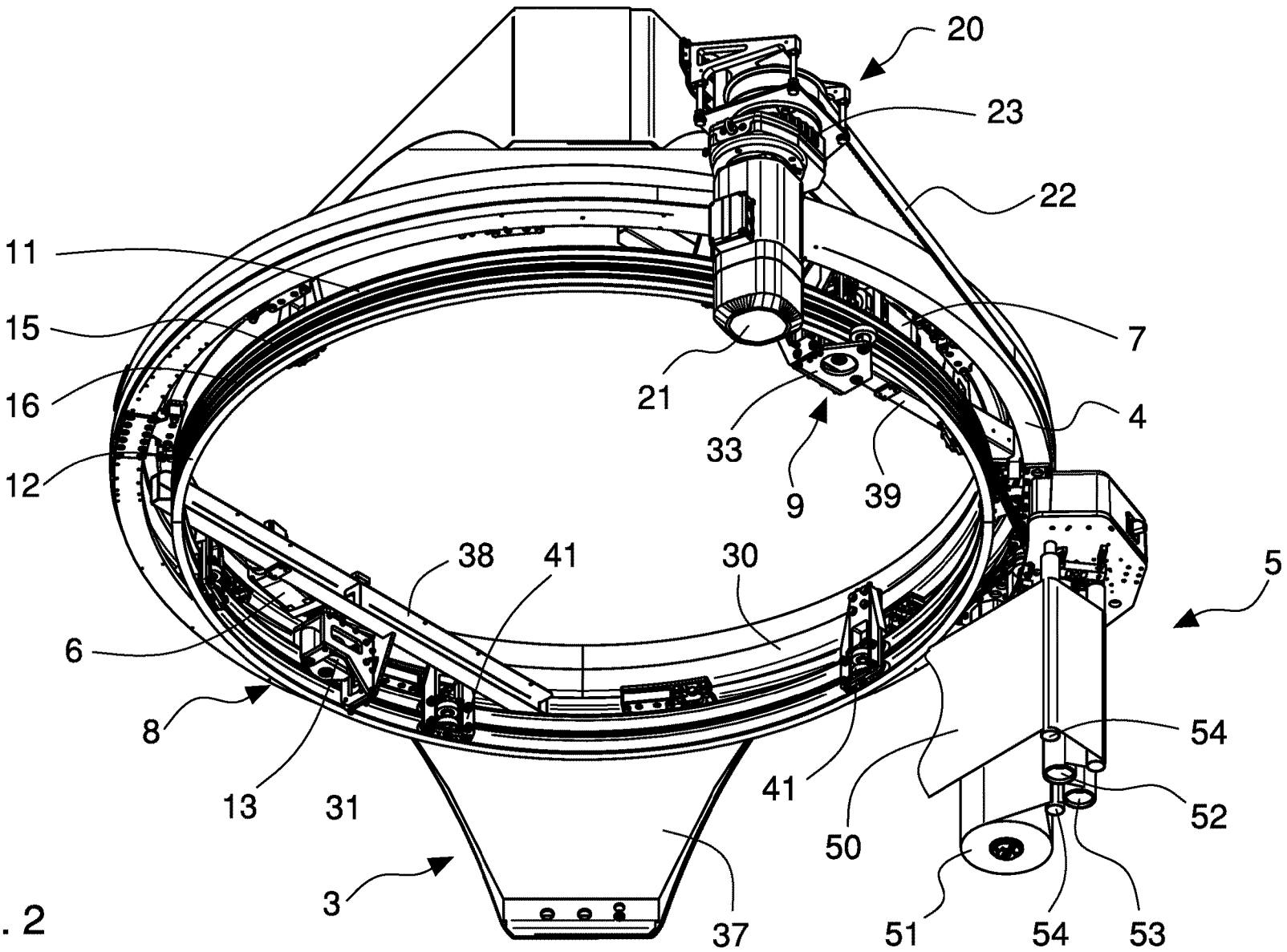
FIG. 2 is a perspective view of the wrapping machine of FIG. 1 from below, wherein some parts have been removed to better illustrate a supporting ring of an unwinding unit and transmission assemblies which connect pre-stretching motors to respective pre-stretching rollers.
Figure 3:
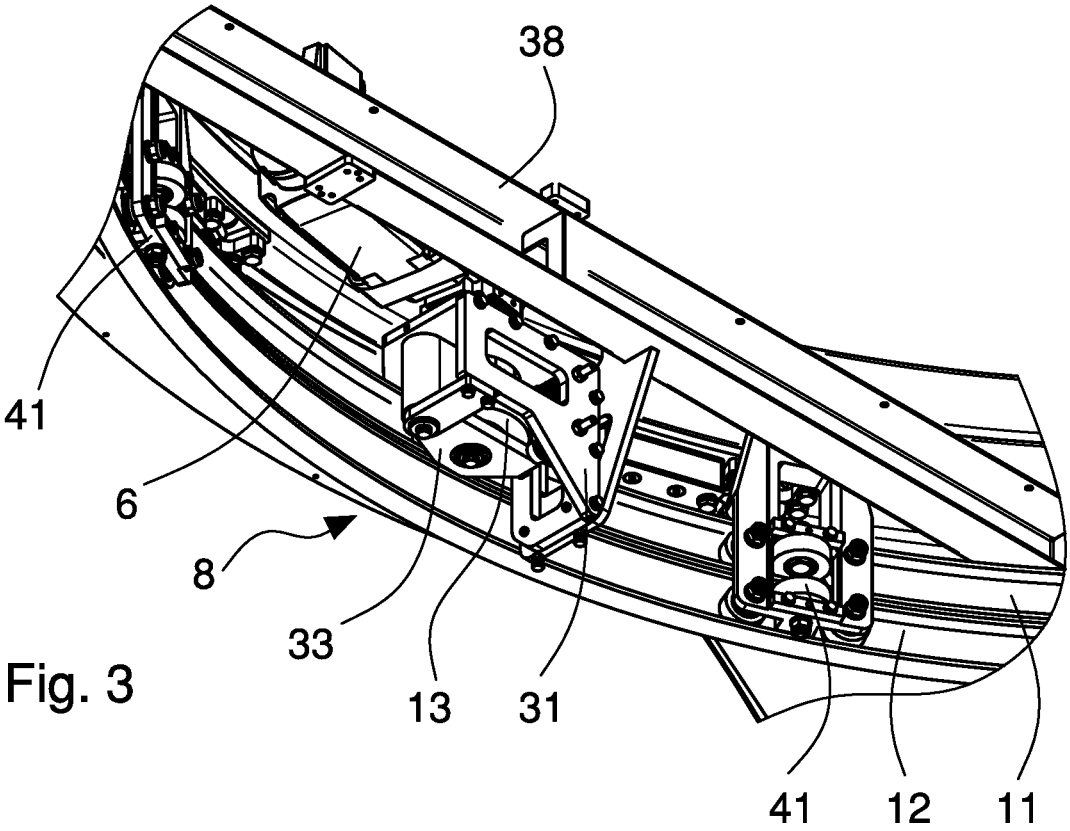
FIGS. 3 to 6 are enlarged details of the wrapping machine of FIG. 2.
Figure 4:
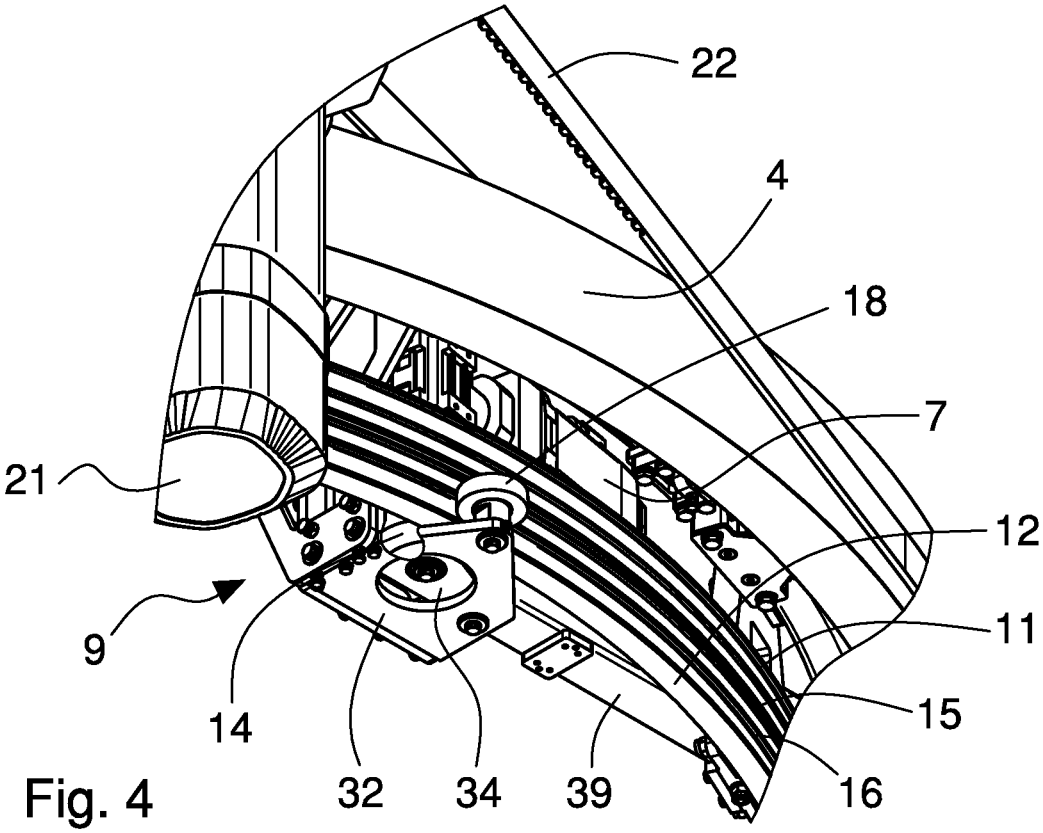
Figure 6:
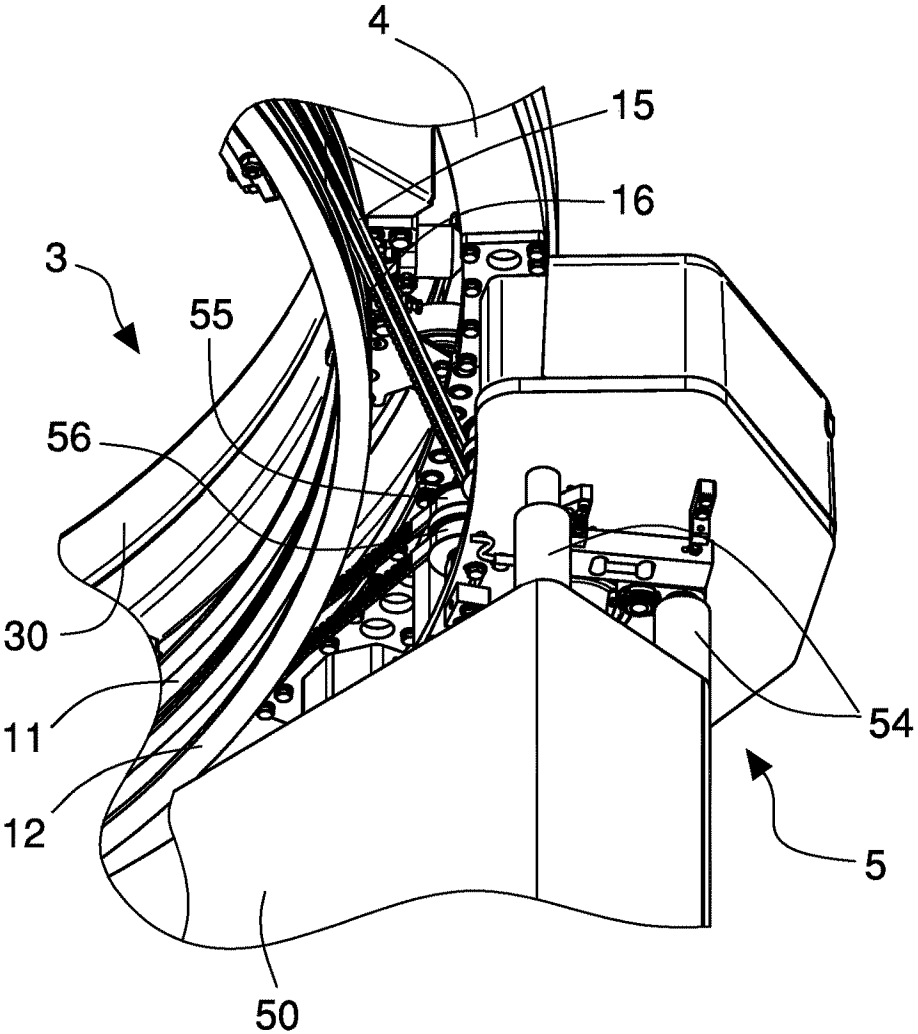
Figure 5:
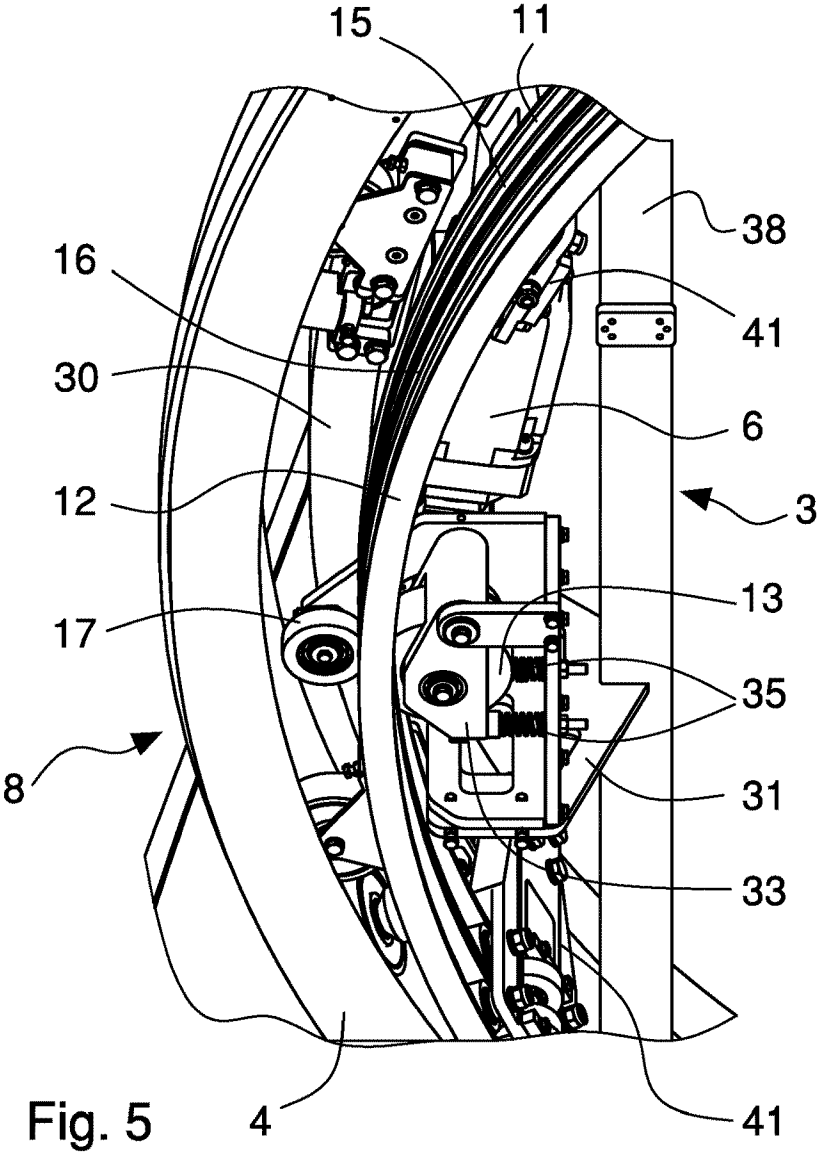

With reference to FIG. 1, the wrapping machine 1 according to the invention is schematically illustrated, arranged to wrap a product or load, not illustrated, with a film 50 of plastic material, in particular a cold-stretchable plastic film.

The wrapping machine 1 comprises frame means 2, 3 arranged to rotatably support a supporting ring 4, or a rotating ring, which can be rotated about a wrapping axis X by first driving means 20.

In the embodiment shown in the figures, the wrapping machine 1 is of the so-called horizontal rotating-ring type and is provided with frame means comprising a main frame 2, provided with a plurality of supporting columns 25, for example two, and a supporting carriage 3 which is slidably coupled to and supported by the main frame 2, and movable along a direction A, parallel to the substantially vertical wrapping axis X.

The supporting carriage 3 is designed to rotatably support the supporting ring 4 and is moved along direction A by second actuating means 60 of a known type.

The two supporting columns 25 of the main frame 2 are facing and opposite each other and are interconnected at the top by a rectilinear beam 26 and below by a connecting tie rod 27. The wrapping machine 1 also includes an unwinding unit 5 fixed to the supporting ring 4 and supporting a reel 51 of the film 50 and a couple of pre-stretching rollers 52, 53 rotating about respective longitudinal axes and cooperating with each other to unwind and stretch the film 50. In particular, the unwinding unit 5 comprises a first pre-stretching roller 52 located downstream of a second pre-stretching roller 53 with reference to a film unwinding direction. The first pre-stretching roller 52, or fast roller, rotates faster than the second pre-stretching roller 53, or slow roller, so as to stretch or lengthen the film 50 by a desired amount or percentage. The unwinding unit 5 further comprises a plurality of return rolls 54 arranged to divert the film 50 unwound from the reel 51 through the pre-stretching rollers 52, 53 and towards the load to be wrapped.

The wrapping machine 1 includes at least one pre-stretching motor 6, 7 fixed to the frame means 2, 3 and coupled to, and arranged to rotate, the pre-stretching rollers 52, 53 through a respective transmission assembly 8, 9.

In the embodiment shown in the figures, the wrapping machine 1 includes a couple of pre-stretching motors 6, 7, each of which is fixed to the frame means 2, 3 and coupled to, and arranged to rotate, a respective pre-stretching roller 52, 53 through a respective transmission assembly 8, 9. The pre-stretching motors 6, 7 are fixed to the supporting carriage 3.

Each transmission assembly 8, 9 comprises a driving ring 11, 12 rotatably supported by the frame means 2, 3 and set in rotation about the wrapping axis X by the respective pre-stretching motor 6, 7 by means of a corresponding friction roller 13, 14, and a driving belt 15, 16 wound around, and rotated by, said driving ring 11, 12 and coupled to a respective pre-stretching roller 52, 53 so as to rotate the latter when the driving ring 11, 12 is rotated by the respective pre-stretching motor 6, 7.

The wrapping machine 1 of the invention can further comprise a feedback control sensor, of a known type and not illustrated in the figures, suitable for directly or indirectly measuring the strain of the film 50 exiting the unwinding unit 5 and sending a relative signal to a control unit of the wrapping machine 1 in order to control the pre-stretching motors 6, 7 as feedback, so as to vary the rotation speeds of the pre-stretching rollers 52, 53 and therefore the speed of unwinding the film 50. In doing so, it is possible to maintain an almost constant winding force or strain of the film 50 wrapped around the load, for example to prevent the film from breaking or avoiding insufficiently tight wrappings.

The control sensor can comprise, for example, a load cell associated with one of the return rollers of the unwinding unit and able to measure the force that the film exerts on said return roller.

With reference to the embodiment illustrated in the figures, the wrapping machine 1 of the invention comprises a first pre-stretching motor 6 coupled to a first pre-stretching roller 52 through a first transmission assembly 8 and a second pre-stretching motor 7 coupled to a second pre-stretching roller 53 through a second transmission assembly 9.

The first transmission assembly 8 comprises a first driving ring 11 set in rotation by a first friction roller 13 driven by the first pre-stretching motor 6 and the second transmission assembly 9 comprises a second driving ring 12 set in rotation by a second friction roller 14 driven by the second pre-stretching motor 7.

The first transmission assembly 8 comprises a first driving belt 15 wound around, and set in rotation by, the first driving ring 11 and coupled to the first pre-stretching roller 52, in particular by means of a first pulley 55. Likewise, the second transmission assembly 9 comprises a second driving belt 16 wound around, and set in rotation by, the second driving ring 12 and coupled to the second pre-stretching roller 53, in particular by means of a second pulley 56.

The first driving ring 11 and the second driving ring 12 are rotatably mounted on the frame means 2, 3, adjacent and coaxial to each other and to the supporting ring 4. In particular, the first driving ring 11 is overlapping the second driving ring 12 with reference to the wrapping axis X.

The driving rings 11, 12 are rotatably fixed to the supporting carriage 3 by means of a plurality of first supports 41. More precisely, the first supports 41 are fixed to a secondary frame 30, for example in the form of a ring, of the supporting carriage 3, which are angularly spaced apart along said secondary frame 30. The first supports 41 comprise respective brackets fixed to the secondary frame 30 and provided with guide rollers which engage and support the driving rings 11, 12. The latter include respective annular elements having, for example, an open cross-section in the form of a "C" defining an annular recess adapted to receive said guide rollers, which are idle, i.e. free to rotate, about respective longitudinal axes. Alternatively, the annular elements of the driving rings 11, 12 may have a closed cross-section, for example square or rectangular.

The supporting carriage 3 further comprises connecting elements 37 arranged to slidably connect the secondary frame 30 to the supporting columns 25 of the main frame 2. In the illustrated embodiment, there are two connecting elements 37, mutually opposite with respect to the wrapping axis X, and are fixed to the respective supporting columns 25 through guide means 29 of a known type which enable the translation of the supporting carriage 3 and the rotating ring 4 along the vertical direction A in both directions and with reduced friction.

The second driving means 60 comprises, in the illustrated embodiment, a respective motor 61 fixed to one of the supporting columns 25 and arranged to move the supporting carriage 3 along the direction A through suitable driving means.

With particular reference to FIGS. 3 to 6, each transmission assembly 8, 9 further comprises a counter roller 17, 18 opposite the respective friction roller 13, 14; the counter roller 17, 18 and the friction roller 13, 14 are in contact with opposite sides of the respective driving ring 11, 12 to better transmit the rotation motion to the latter, as better explained in the following description.

Each transmission assembly 8, 9 comprises a respective supporting element 31, 32 arranged for securing to the frame means 2, 3, in particular to the supporting carriage 3, and supporting the respective pre-stretching motor 6, 7, friction roller 13, 14 and counter roller 17, 18.

More precisely, a first fastening element 31 of the first transmission assembly 8 is secured to the supporting carriage 3, in particular secured to a first beam 38 of the latter, having the ends connected to the secondary frame 30, and supports the first pre-stretching motor 6, the first friction roller 13 and a first counter roller 17.

Similarly, a second fastening element 32 of the second transmission assembly 9 is secured to the supporting carriage 3, in particular secured to a second beam 39 of the latter having the ends connected to the secondary frame 30, and supports the second pre-stretching motor 7, the second friction roller 14 and the second counter roller 18.

Each transmission assembly 8, 9 includes respective adjustment means 33, 34, 35 interposed between the friction roller 13, 14 and the supporting element 31, 32 and arranged to press or push the friction roller 13, 14 with a defined thrust force against the driving ring 11, 12 and the opposite counter roller 17, 18.

The adjustment means of each transmission assembly 8, 9 comprise a respective supporting arm 33, 34, having one end rotatably fixed to the supporting element 31, 32 and rotatably supporting a respective friction roller 13, 14, and respective elastic means 35 fixed to the corresponding supporting element 31, 32 and acting on the supporting arm 33, 34 to push the latter and therefore the friction roller 13, 14 against the driving ring 11, 12 with the necessary and defined thrust force so as to avoid any slipping of the friction roller 13, 14 during operation and transmission of the rotation torque to the driving ring 11, 12. The elastic means 35 comprises, for example, one or more helical springs fixed to the supporting elements 31, 32 and subjected to compression in such a way as to exert an elastic thrust force on the supporting arm 33, 34.

In the illustrated embodiment, first adjustment means of the first transmission assembly 8 comprises a first supporting arm 33 which has an end rotatably attached to a first supporting element 31 and which rotatably supports the first friction roller 13 and respective elastic means 35 comprising a couple of helical springs fixed to the first supporting element 31 and acting on the first supporting arm 33 to push the latter and therefore the first friction roller 13 against the first driving ring 11.

Similarly, second adjustment means of the second transmission assembly 9 comprise a second supporting arm 34 which has an end rotatably attached to a second supporting element 32 and which rotatably supports the second friction roller 14 and respective elastic means comprising a couple of helical springs fixed to the second supporting element 32 and acting on the second supporting arm 34 to push the latter and therefore the second friction roller 14 against the second driving ring 12.

The first driving means 20 comprise a third motor 21 fixed to the frame means 2, 3 and arranged to drive or rotate the supporting ring 4 by means of a third driving belt 22. In particular, the third motor 21 is mounted on the supporting carriage 3, more precisely on one of the two connecting elements 37 and set in rotation, by means of a speed reducer 23, a driving pulley coupled to the third driving belt 22, for example of the toothed type, which is wound around the supporting ring 4.

In operation, by means of the third driving belt 22, the third motor 21 rotates the supporting ring 4 on which the unwinding unit 5 is fixed, which then rotates around the load or product to be wrapped.

The first pre-stretching motor 6 drives the first driving ring 11 by means of the first friction roller 13, which then rotates the first driving belt 15. The latter, engaged on the first pulley 55, rotates the first pre-stretching roller 52 with a fixed rotation speed.

Likewise, the second pre-stretching motor 7 drives the second driving ring 12 by means of the second friction roller 14, which then rotates the second driving belt 16. The latter, engaged on the second pulley 56, rotates the second pre-stretching roll 52 with a fixed rotation speed, so as to stretch the film 50 unwound from the reel 51 to a desired quantity or percentage.

It should be noted that since the pre-stretching motors 6, 7 are fixed to the supporting carriage 3 and not to the rotating ring 4, as generally occurs in known wrapping machines, it is possible to considerably lighten the weight of said rotating ring 4. In addition to providing a simpler and less expensive structure, this makes it possible to considerably increase the rotation speed of the rotating ring due to the reduction of the inertial masses. Moreover, by means of the respective transmission assemblies 8, 9, the two pre-stretching motors 6, 7 allow the pre-stretching rollers 52, 53 to be driven separately and independently in order to quickly and precisely vary the rotation speeds of the latter, for example for adjusting and controlling, during operation, a tension or wrapping force of the film 50 wrapped on the load and/or a quantity or percentage of pre-stretch or elongation to which the film 50 is subjected to during wrapping around the load, depending on the characteristics of the film used or the type of product to be wrapped.

The transmission assemblies 8, 9 form the kinematic chains which connect the pre-stretching motors 6, 7 to the respective pre-stretching rollers 52, 53 and transmit the necessary rotation and torque to the same.

It should be noted that the transmission assemblies 8, 9 of the wrapping machine 1 of the invention form particularly simple kinematic chains with a very short development or length, thus allowing a high efficiency and operative effectiveness (in driving motion) and high mechanical and energy efficiency.

Moreover, when feedback control of the rotation speed of the pre-stretching rollers 52, 53 is present by means of a sensor and the wrapping machine control unit, the transmission assemblies 8, 9 make it possible to vary the speed of the pre-stretching rollers 52, 53 with a minimum delay with respect to the actual request sent to the pre-stretching motors 6, 7 so as to avoid excessive straining on the film 50 in unwanted portions of the load to be wrapped (or even the breakage of the film itself) or an insufficient wrapping force of the film around the load.

In this regard it should be noted that the transmission of the rotation motion from the pre-stretching motors 6, 7 to the driving rings 11, 12 by means of the friction rollers 13, 14 assisted by the counter rollers 17, 18 and by the adjustment means 33, 34, 35 occurs in a precise and accurate way, almost without any slipping or sliding that can influence the correct and required operation of the pre-stretching rollers.

In a variant not shown in the figures of the wrapping machine 1 of the invention, the latter comprises a single pre-stretching motor fixed to the frame means 2, 3, in particular to the supporting carriage 3, and coupled to, and arranged to rotate, the pre-stretching rollers 52, 53 through a transmission assembly.

In this variant of the wrapping machine, the unwinding unit 5 comprises a motion transmission device adapted to connect the pre-stretching rollers to each other such that, through the transmission assembly, the pre-stretching motor can directly rotate one of the pre-stretching rollers (for example the "fast" roller) and, through the motion transmission device, the remaining pre-stretching rollers (the "slow" roller). The motion transmission device is, for example, a speed reducer with toothed wheels or belts and pulleys, or a mechanical regulator.

In another embodiment not shown in the figures, the wrapping machine 1 of the invention is of the type with a vertical rotating ring and is provided with frame means comprising a main frame which rotatably supports the rotating supporting ring about a horizontal wrapping axis. Conveyor means support and move the loads/products to be wrapped along a feed direction parallel to the wrapping axis, through the supporting ring.

In this embodiment, the pre-stretching motor(s) which actuate the pre-stretching rollers by means of the respective transmission assemblies are fixed to the main frame and, likewise, the driving ring(s) of the transmission assemblies are rotatably connected to the main frame.

The operation of this embodiment of the wrapping machine 1 is substantially similar to that of the previously described horizontal rotating-ring wrapping machine, as in this case the wrapping with the film 50 is carried out by rotating the unwinding unit 5 around the product while the latter is advanced through the supporting ring in the direction of travel.

The invention claimed is:

1. A wrapping machine for wrapping a product with a plastic film, the wrapping machine comprising:

a frame;

a supporting ring rotatably supported by said frame and rotatably movable about a wrapping axis by a first driving device;

an unwinding unit fixed to said supporting ring, wherein said unwinding unit supports a reel of the plastic film and a plurality of pre-stretching rollers that rotate about respective longitudinal axes and cooperate to unwind and stretch the plastic film;

at least one pre-stretching motor fixed to said frame and coupled to, and arranged to rotate, said pre-stretching rollers by means of transmission assembly, wherein said transmission assembly comprises:

a driving ring rotatably supported by said frame and set in rotation about the wrapping axis by said at least one pre-stretching motor by means of a friction roller, a driving belt wound around and set in rotation by said driving ring and coupled to said pre-stretching rollers so as to rotate said pre-stretching rollers when said driving ring is rotated by said pre-stretching motor;

a counter roller that is opposed to said friction roller, said counter roller and said friction roller abutting opposite sides of said driving ring;

a supporting element arranged for securing to said frame and supporting said pre-stretching motor, said friction roller and said counter roller; and an adjustment assembly interposed between said friction roller and said supporting element and arranged to push said friction roller with a defined thrust force against said driving ring.

2. The wrapping machine according to claim 1, wherein said at least one pre-stretching motor is a plurality of pre-stretching motors, said transmission assembly is a plurality of transmission assemblies, each of said plurality of pre-stretching motors is fixed to said frame and coupled to, and arranged to rotate, a respective one of said pre-stretching rollers by means of a respective one of said plurality of transmission assemblies.

3. The wrapping machine according to claim 1, wherein said adjustment assembly comprises a supporting arm, wherein said supporting arm has an end that is rotatably fixed to said supporting element and rotatably supports said friction roller, and an elastic element that is fixed to said supporting element and acts on said supporting arm to push said supporting arm and said friction roller against said driving ring with the defined thrust force.

4. The wrapping machine according to claim 1, further comprising a second transmission assembly, wherein said at least one pre-stretching motor is a first pre-stretching motor and a second pre-stretching motor, said transmission assembly is a first transmission assembly, said plurality of pre-stretching rollers includes a first pre-stretching roller and a second pre-stretching roller, said first pre-stretching motor is coupled to said first pre-stretching roller by means of a said first transmission assembly and said second pre-stretching motor is coupled to said second pre-stretching roller by means of said second transmission assembly, and said first transmission assembly comprises said driving ring, as a first driving ring, set in rotation by said friction roller, as a first friction roller, operated by said first pre-stretching motor and said second transmission assembly comprises a second driving ring set in rotation by a second friction roller operated by said second pre-stretching motor.

5. The wrapping machine according to claim 4, wherein said first driving ring and said second driving ring are rotatably mounted on said frame, adjacent and coaxial to each other and to said supporting ring.

6. The wrapping machine according to claim 4, wherein said driving belt, as a first driving belt, of said first transmission assembly is wound around, and set in rotation by, said first driving ring and coupled to said first pre-stretching roller, and said second transmission assembly further comprises a second driving belt wound around, and set in rotation by, said second driving ring and coupled to said second pre-stretching roller.

7. The wrapping machine according to claim 1, wherein said unwinding unit comprises a motion transmission device configured for connecting said pre-stretching rollers to each other, said at least one pre-stretching motor being coupled to, and arranged to rotate, one of said pre-stretching rollers and, by means of said motion transmission device, another of said pre-stretching rollers.

8. The wrapping machine according to claim 1, wherein said frame comprises a main frame, provided with a plurality of supporting columns, and a supporting carriage slidingly supported by said main frame, movable along a direction parallel to the wrapping axis and arranged to rotatably support said supporting ring, and said at least one pre-stretching motor is mounted on said supporting carriage.

9. The wrapping machine according to claim 1, wherein said first driving device comprises a third motor fixed to said frame and arranged to drive said supporting ring by means of a third driving belt.

10. The wrapping machine according to claim 8, wherein said first driving device comprises a third motor fixed to said supporting carriage and arranged to drive said supporting ring by means of a third driving belt.

11. The wrapping machine according to claim 5, wherein said driving belt, as a first driving belt, of said first transmission assembly is wound around, and set in rotation by, said first driving ring and coupled to said first pre-stretching roller, and said second transmission assembly further comprises a second driving belt wound around, and set in rotation by, said second driving ring and coupled to said second pre-stretching roller.

* * * * *